US008746277B2

(12) United States Patent
Okazono et al.

(10) Patent No.: US 8,746,277 B2
(45) Date of Patent: Jun. 10, 2014

(54) FUEL FEED APPARATUS

(75) Inventors: Tetsuro Okazono, Okazaki (JP); Hironobu Oki, Oyama (JP)

(73) Assignees: Denso Corporation, Kariya (JP); Kyosan Denki Co., Ltd., Koga (JP)

( * ) Notice: Subject to any disclaimer, the term of this patent is extended or adjusted under 35 U.S.C. 154(b) by 348 days.

(21) Appl. No.: 13/230,049

(22) Filed: Sep. 12, 2011

(65) Prior Publication Data

US 2012/0060949 A1 Mar. 15, 2012

(30) Foreign Application Priority Data

Sep. 13, 2010 (JP) ..... 2010-204622

(51) Int. Cl.
*F02M 37/10* (2006.01)
*F02M 37/22* (2006.01)
*F04D 29/18* (2006.01)

(52) U.S. Cl.
USPC ..... 137/565.17; 137/565.34; 123/209; 417/360; 417/361

(58) Field of Classification Search
USPC ..... 137/565.17, 565.34; 123/509; 417/360, 417/361
See application file for complete search history.

(56) References Cited

U.S. PATENT DOCUMENTS

| | | | | |
|---|---|---|---|---|
| 4,869,225 | A | 9/1989 | Nagata et al. | |
| 5,040,954 | A * | 8/1991 | Iwai | 417/423.12 |
| 6,431,147 | B1 * | 8/2002 | Hiraiwa et al. | 123/458 |
| 6,719,539 | B1 | 4/2004 | Yoshioka | |

FOREIGN PATENT DOCUMENTS

| | | |
|---|---|---|
| EP | 0 903 255 | 1/2004 |
| JP | 10-061519 | 3/1998 |
| JP | 10-141159 | 5/1998 |
| JP | 2002-256993 | 9/2002 |
| JP | 2007-2696 | 1/2007 |

OTHER PUBLICATIONS

U.S. Appl. No. 13/230,076, of Okazono, filed Sep. 12, 2011.
U.S. Appl. No. 13/230,027, of Okazono, filed Sep. 12, 2011.
U.S. Appl. No. 13/229,995, of Okazono, filed Sep. 12, 2011.
Office Action (2 pages) dated Apr. 1, 2014 issued in corresponding Japanese Application No. 2010-204622 and English translation (3 pages).

* cited by examiner

*Primary Examiner* — Atif Chaudry
(74) *Attorney, Agent, or Firm* — Nixon & Vanderhye PC

(57) ABSTRACT

A fuel pump has a pump chamber accommodating a rotor member. The rotor member is rotatable to supply fuel to from a tank to an exterior of the tank. A case is supported in the tank. The case accommodates a part of the fuel pump. A pump bracket is located in the tank. The pump bracket is in a tubular bottomed shape having a sidewall portion in which a remaining portion of the fuel pump is inserted such that the sidewall portion surrounds a radially outside of the pump chamber of the remaining portion. The pump bracket is joined with the case to define a gap therebetween in a radial direction of the rotor member such that the pump bracket is movable relative to the case.

8 Claims, 7 Drawing Sheets

FUEL FEED APPARATUS

CROSS REFERENCE TO RELATED APPLICATIONS

This application is based on and claims priority to Japanese Patent Application No. 2010-204622 filed on Sep. 13, 2010, the contents of which are incorporated in their entirely herein by reference.

FIELD OF THE INVENTION

The present invention relates to a fuel feed apparatus configured to supply fuel in a tank to an exterior of the tank.

BACKGROUND OF THE INVENTION

A known fuel feed apparatus includes a fuel pump having a rotor member being rotative to supply fuel to an exterior of a tank. JP-A-2007-2696 discloses one example of a fuel feed apparatus including a pump case supported in a tank. The pump case accommodates a fuel pump. Such a pump case enables accurate positioning of the fuel pump in the tank. Thus, the fuel pump can steadily produce its fuel discharge performance. In the fuel feed apparatus of JP-A-2007-2696, it is noted that the fuel pump is entirely fitted to the radially inside of the case and accommodated in the tank. Therefore, it is conceived that the case surrounds the radially outside of the pump chamber of the fuel pump accommodating the rotor member. In such a configuration, the rotor member rotates in the pump chamber to cause vibration mainly in the radial direction. Such vibration may be directly transmitted to the case. Further, such vibration may be transmitted to the tank supporting the case. Consequently, transmitted vibration may cause abnormal noise in the case and the tank.

SUMMARY OF THE INVENTION

In view of the foregoing and other problems, it is an object of the present invention to produce a fuel feed apparatus configured to reduce abnormal noise.

According to one aspect of the present invention, a fuel feed apparatus configured to supply fuel from a tank to an exterior of the tank, the fuel feed apparatus comprises a fuel pump having a pump chamber accommodating a rotor member, the rotor member being rotatable to supply fuel to the exterior of the tank. The fuel feed apparatus further comprises a case supported in the tank, the case accommodating a part of the fuel pump. The fuel feed apparatus further comprises a pump bracket located in the tank, the pump bracket being in a tubular bottomed shape having a sidewall portion in which a remaining portion of the fuel pump is inserted such that the sidewall portion surrounds a radially outside of the pump chamber of the remaining portion, the pump bracket being joined with the case to define a gap therebetween in a radial direction of the rotor member such that the pump bracket is movable relative to the case.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

As follows, an embodiment of the present invention will be described with reference to drawings.

(General Configuration)

Figure 1:
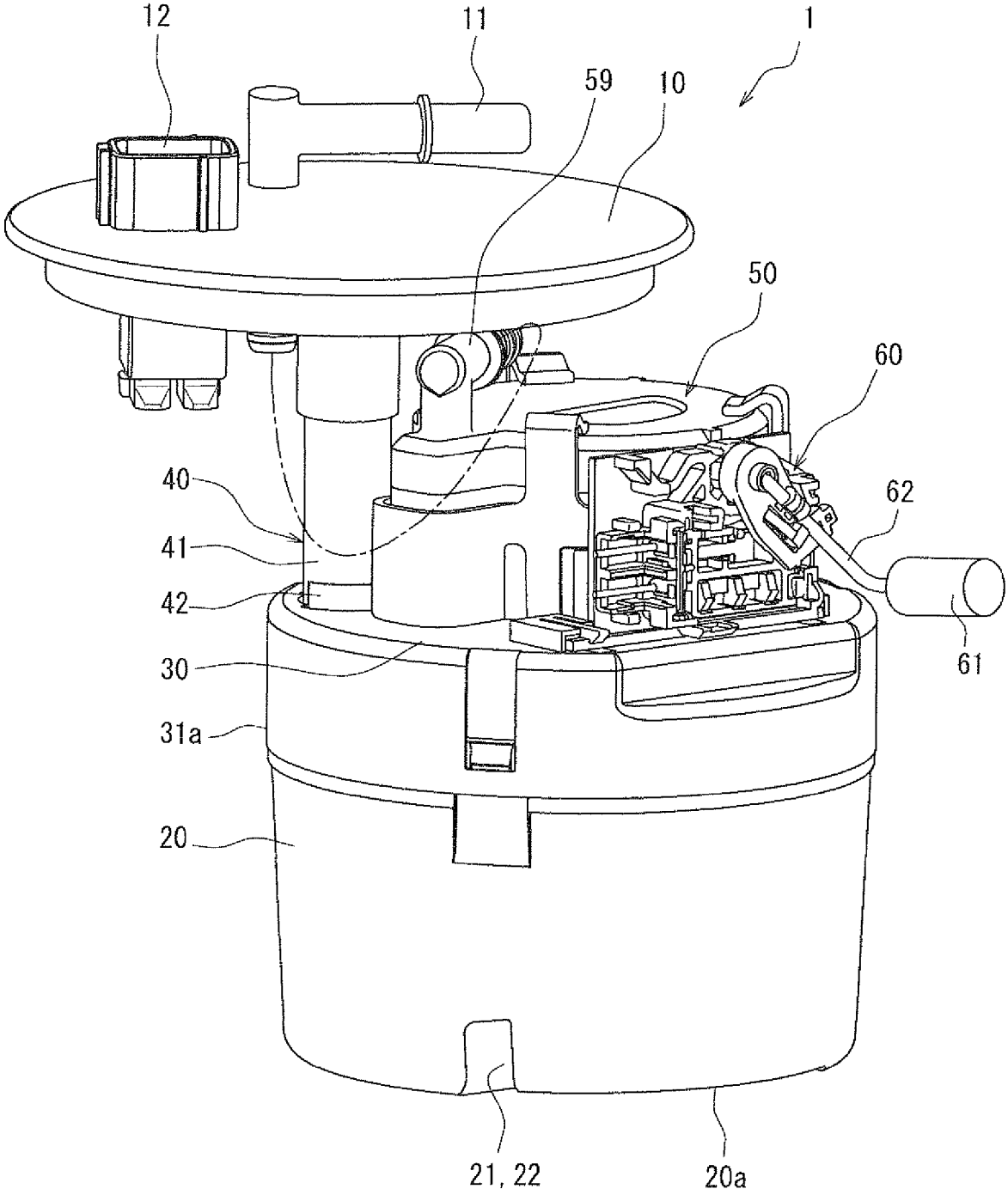
FIG. 1 is a perspective view showing a fuel feed apparatus according to an embodiment.
Figure 2:
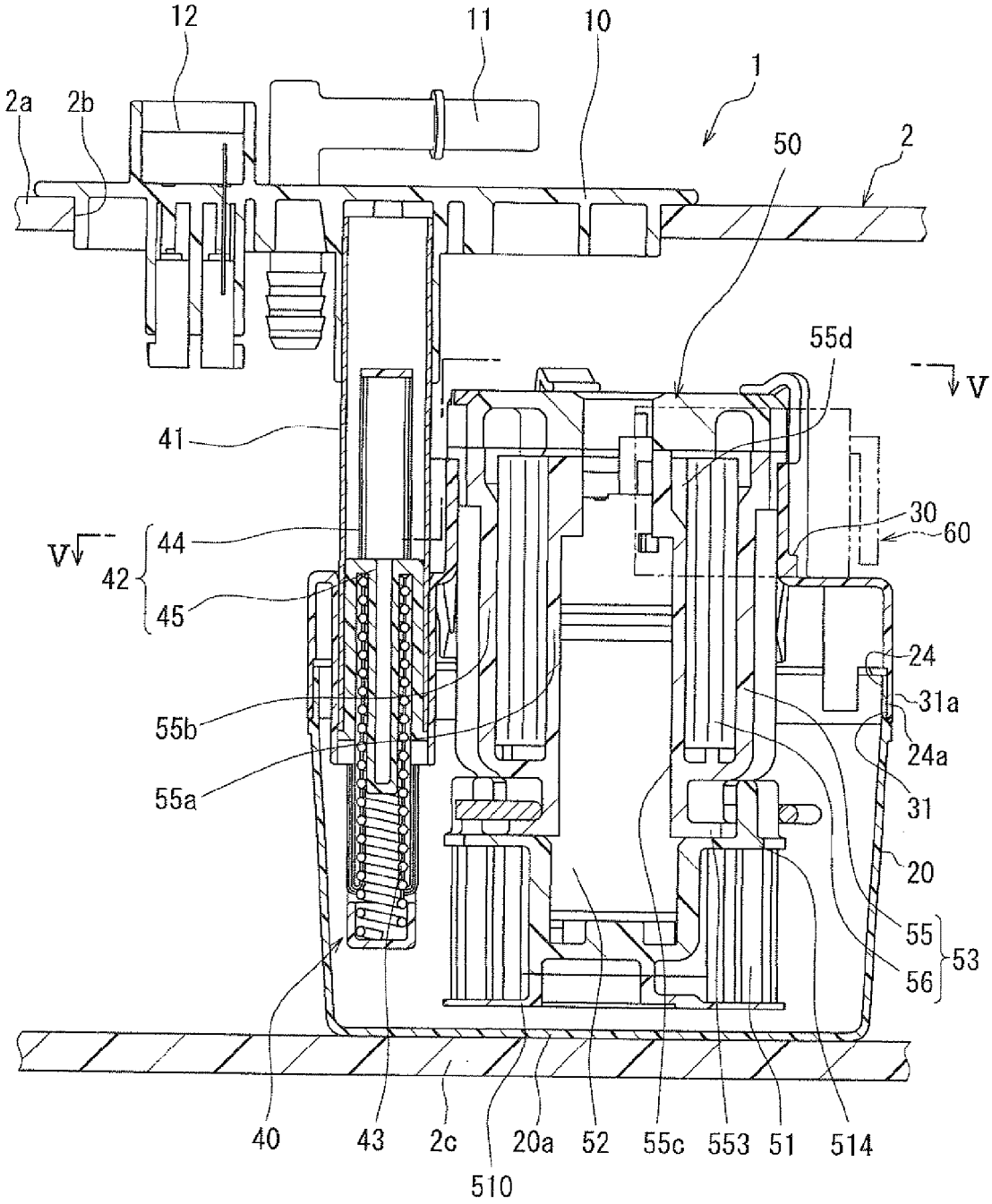
FIG. 2 is a sectional view showing the fuel feed apparatus, the sectional view taken along the line II-II in FIG. 3.

FIGS. 1, 2 show a fuel feed apparatus according to an embodiment. A fuel feed apparatus 1 is equipped in a fuel tank 2 of a vehicle for feeding fuel to an exterior of the fuel tank 2. The fuel feed apparatus 1 includes a flange 10, a reservoir 20, a lid member 30, an adjustment device 40, a pump unit 50, and a remaining quantity detector 60. As shown in FIG. 2, components 20, 30, 40, 50, and 60 of the fuel feed apparatus 1 other than the flange 10 are located at a predetermined position inside the fuel tank 2. The vertical direction in FIG. 2 substantially coincides with the vertical direction of the vehicle being on a horizontal surface.

Figure 3:
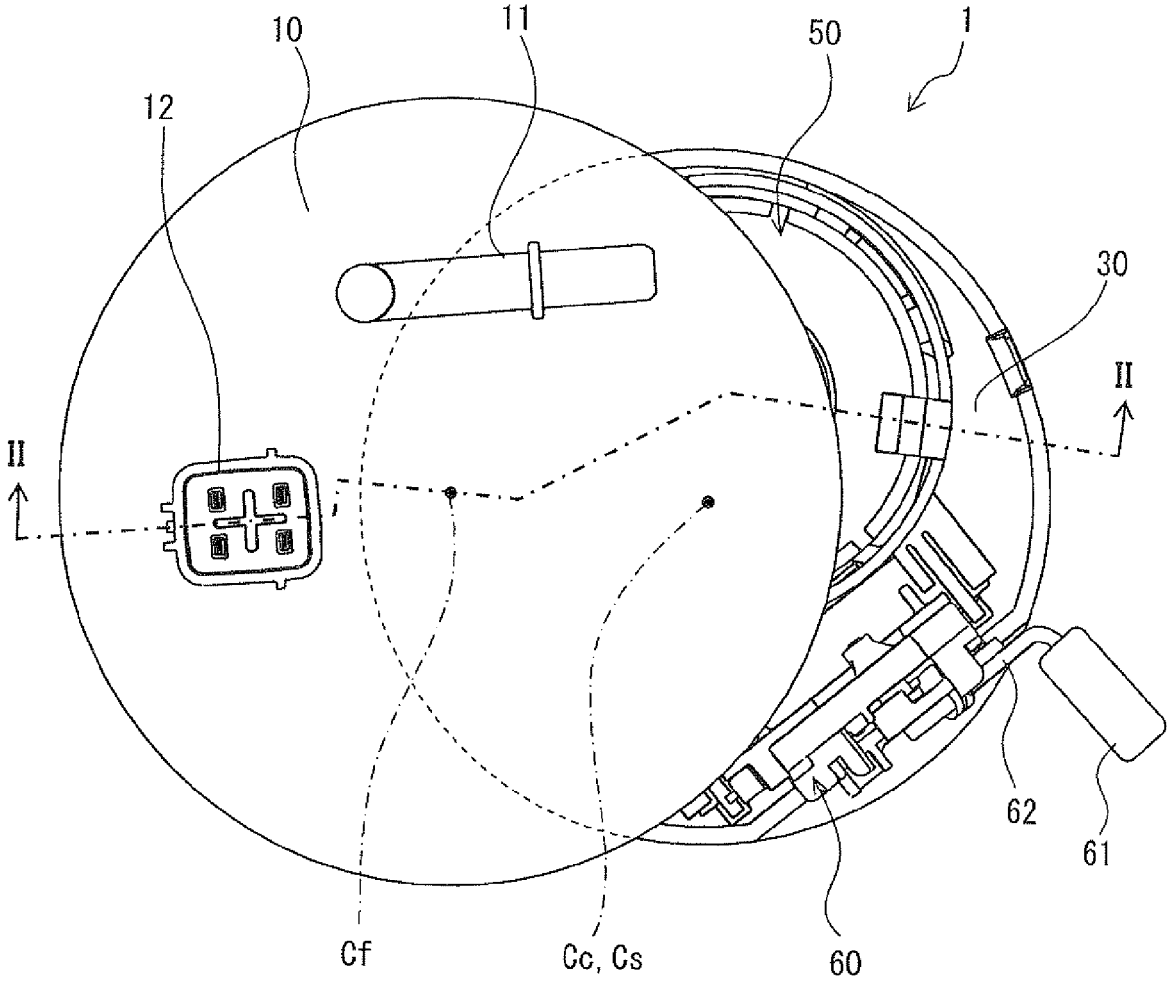
FIG. 3 is a top view showing the fuel feed apparatus.

As shown in FIGS. 1 to 3, the flange 10 in a disc shape is formed of resin. The flange 10 is fitted a through hole 2*b* to close the through hole 2*b*. The through hole 2*b* extends through a top plate portion 2*a* of the fuel tank 2. A fueling pipe 11 and an electrical connector 12 are provided to the flange 10. The fueling pipe 11 is used for supplying fuel discharged from the pump unit 50 to the exterior of the fuel tank 2. The electrical connector 12 is electrically connected with the pump unit 50 and the remaining quantity detector 60. In the present configuration, a fuel pump 52 of the pump unit 50 is supplied with an electric power through the electrical connector 12, thereby being driven and controlled. In addition, the remaining quantity detector 60 outputs a remaining quantity detection signal through the electrical connector 12.

Figure 4:
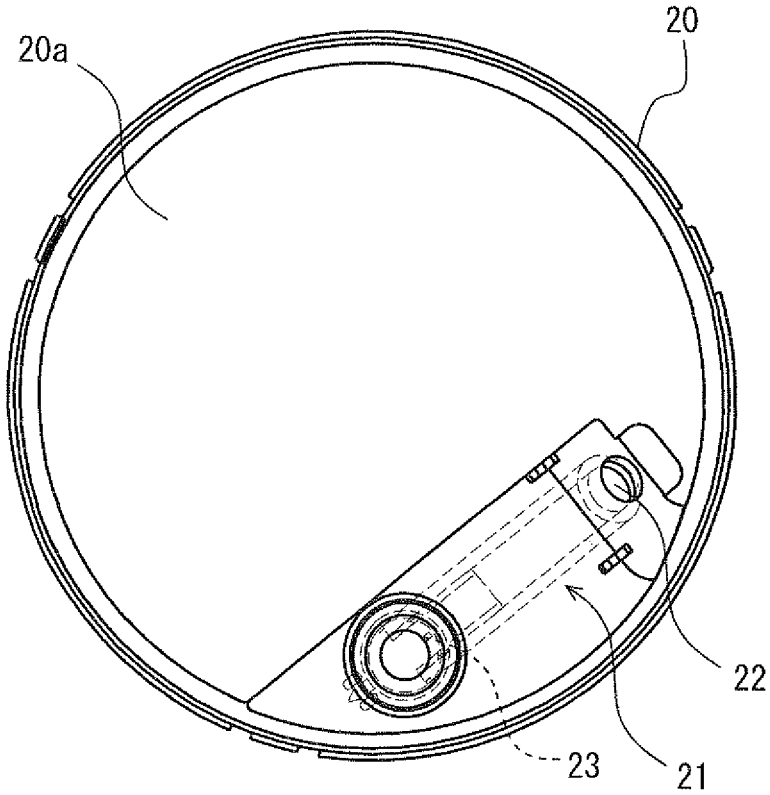
FIG. 4 is a top view showing a reservoir of the fuel feed apparatus.
Figure 5:
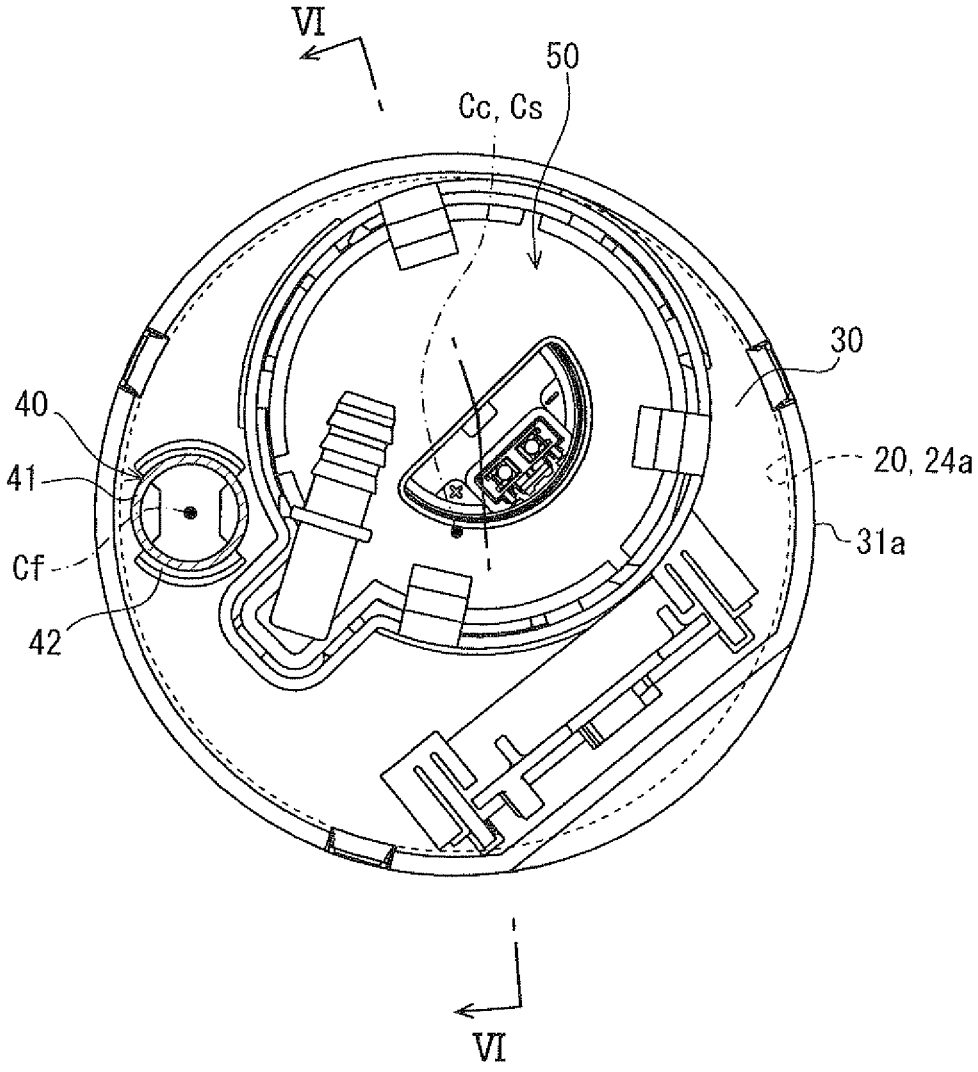
FIG. 5 is a sectional view taken along the line V-V in FIG. 2.
Figure 6:
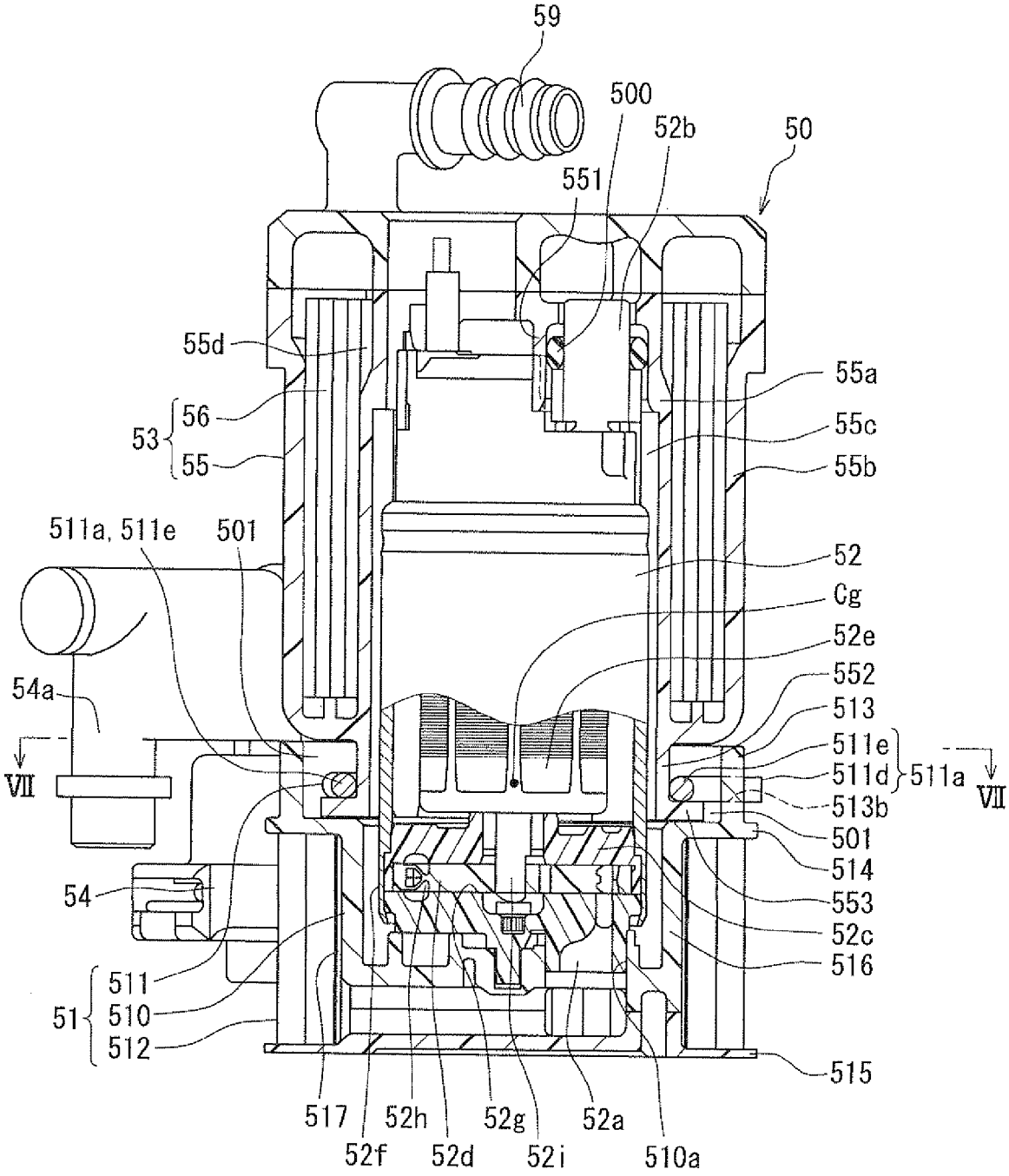
FIG. 6 is a sectional view taken along the line VI-VI in FIG. 5.

As shown in FIGS. 1, 2, the reservoir 20 being in a bottomed tubular shape is formed of resin. The reservoir 20 is accommodated in the fuel tank 2 and located on a bottom portion 2*c* of the fuel tank 2. As shown in FIGS. 3, 5, the reservoir 20 has a center axis Cs being offset from a center axis Cf of the flange 10. As shown in FIGS. 1, 4, a jet pump 21 is provided to a bottom portion 20*a* of the reservoir 20. The jet pump 21 has an introduction passage 22 and a jet nozzle 23. The introduction passage 22 communicates the interior of the fuel tank 2 with the interior of the reservoir 20. As shown in FIG. 6, a pressure regulator 54 of the pump unit 50 exhausts surplus fuel. The jet nozzle 23 jets the exhausted surplus furl into the introduction passage 22. The fuel jet causes a negative pressure in the introduction passage 22. The negative pressure, which is lower than atmospheric pressure, causes the introduction passage 22 to draw fuel from the fuel tank 2 into the reservoir 20. The reservoir 20 stores the fuel drawn in this way.

As shown in FIGS. 1, 2, 5, the lid member 30 formed of resin is in a tubular shape having a ceiling. The lid member 30 has a circumferential periphery 31*a* defining a lower opening 31. The circumferential periphery 31*a* of the lid member 30 is fitted to a circumferential periphery 24*a* of an upper opening 24 of the reservoir 20. The lid member 30 is coaxial with the reservoir 20. As show in FIGS. 3, 5, a center axis Cc of the lid member 30 is offset from (i.e., located at a different position from) the center axis Cf of the flange 10. The lid member 30 blocks the opening 24 of the reservoir 20 accommodated in the fuel tank 2. The lid member 30 holds the pump unit 50 and the remaining quantity detector 60 in the fuel tank 2.

The adjustment device 40 includes a pillar 41, an intermediate member 42, and a resilient member 43. The pillar 41 formed of metal is in a tubular shape. The pillar 41 is press-fitted to the flange 10 to be coaxial with the flange 10. The pillar 41 is integrated with components (integrated components) 20, 30, 50, 60 via the intermediate member 42. In this way, the flange 10 is connected with the integrated components 20, 30, 50, 60 via the pillar 41 being a single component.

As shown in FIG. 2, the intermediate member 42 includes a pair of brackets 44, 45 formed of resin. The brackets 44, 45 are not rotative relative to each other in the circumferential direction of the pillar 41. The brackets 44, 45 are movable relative to each other in the axial direction of the pillar 41. The brackets 44, 45 are mounted to the lid member 30 and the pillar 41. Thereby, the intermediate member 42 constructed of the brackets 44, 45 regulates relative movement between the pillar 41 and the integrated components 20, 30, 50, 60 in the circumferential direction of the pillar 41 while allowing relative movement between the pillar 41 and the integrated components 20, 30, 50, 60 in the axial direction of the pillar 41.

In the present example, the resilient member 43 is a coil spring. The resilient member 43 is interposed between the bracket 45 of the intermediate member 42 and the lid member 30. The bracket 45 is integrated with the pillar 41. The resilient member 43 applies a resilient force in the axial direction of the pillar 41 to bias the integrated components 20, 30, 50, 60 toward the bottom portion 2*c* of the fuel tank 2. Thereby, the resilient member 43 regularly biases the bottom portion 20*a* of the reservoir 20 onto the bottom portion 2*c* of the fuel tank 2. In the present embodiment, the resilient member 43 and the intermediate member 42 function to stabilize the positions of the integrated components 20, 30, 50, 60 in the fuel tank 2.

The pump unit 50 has a lower portion accommodated in the reservoir 20 and an upper portion projecting from the lid member 30. As shown in FIGS. 2, 6, the pump unit 50 includes a suction filter 51, the fuel pump 52, a fuel filter 53, and a pressure regulator 54.

The suction filter 51 is located at the lowermost portion of the pump unit 50. The suction filter 51 is connected with a fuel inlet port 52*a* of the fuel pump 52 for removing large foreign matter contained in fuel drawn by the fuel pump 52 from the reservoir 20.

The fuel pump 52 is located on the upper side of the suction filter 51 in the pump unit 50. The fuel inlet port 52*a* extends downward from the fuel pump 52. The fuel outlet port 52*b* extends upward from the fuel pump 52. As shown in FIG. 6, the fuel pump 52 includes a housing 52*f* accommodating a pump case 52*c*, a rotor member 52*d*, and an electric motor 52*e*. The pump case 52*c* has a pump chamber 52*g* communicating with the fuel inlet port 52*a* and the fuel outlet port 52*b*. In the present example, the rotor member 52*d* is a disc-shaped impeller having multiple vane grooves 52*h* arranged in the circumferential direction (rotative direction). The rotor member 52*d* is accommodated in the pump chamber 52*g*. The axial direction of a rotation shaft of the rotor member 52*d* substantially coincides with the vertical direction of the pump chamber 52*g*. The electric motor 52*e* is supplied with an electric power through the electrical connector 12 (FIG. 2) and configured to rotate a driving shaft 52*i* coaxially connected with the rotor member 52*d*. The rotor member 52*d* rotates together with the driving shaft 521 to draw fuel from the reservoir 20 into the fuel inlet port 52*a* through the suction filter 51. The drawn fuel is pressurized in the pump chamber 52*g* by each of the vane grooves 52*h* of the rotor member 52*d*. Thus, the pressurized fuel is discharged from the fuel outlet port 52*b*.

As shown in FIGS. 2, 6, the fuel filter 53 is located in the pump unit 50. The fuel filter 53 surrounds the upper portion and the circumferential periphery of the fuel pump 52. A filter case 55 of the fuel filter 53 includes tubular portions 55*a*, 55*b* formed of resin. The tubular portions 55*a*, 55*b* have a two-layer structure including an inner tubular portion 55*a* defining an inner space 55*c* in which the fuel pump 52 is located. The fuel pump 52 is coaxial with the tubular portion 55*a*. A filter element 56 of the fuel filter 53 is, for example, a honeycomb-like filter sheet. The filter element 56 is accommodated in a space 55*d* between the inner tubular portion 55*a* and an outer tubular portion 55*b*. The space 55*d* defined between the tubular portions 55*a*, 55*b* has a fuel upstream side and a fuel downstream side on both sides of the filter element 56. The fuel upstream side and the fuel downstream side respectively communicate with the fuel outlet port 52*b* of the fuel pump 52 and a fuel outlet 59 of the fuel filter 53. In the present structure, fuel is discharged from the fuel outlet port 52*b* to the space 55*d*, and microscopic foreign matter contained in the discharged fuel is removed through the filter element 56. The fuel is, as shown by the dashed dotted line in FIG. 1, supplied to the fueling pipe 11 connected with the fuel outlet 59.

As show in FIG. 6, the pressure regulator 54 is adjacent to the side of the fuel filter 53 in the pump unit 50. Fuel is supplied to the fueling pipe 11 located outside of the tanks 20, 2, and the fuel partially flows into the pressure regulator 54 connected with the fuel outlet 59 of the fuel filter 53. In the present structure, the pressure regulator 54 controls a pressure of the fuel flowing into the fueling pipe 11. The pressure regulator 54 generates surplus fuel when regulating the pressure of fuel and discharges the surplus fuel to the jet nozzle 23 (FIG. 4) of the jet pump 21 through an exhaust pipe 54*a*.

As shown in FIGS. 1, 3, the remaining quantity detector 60 is supported on the lid member 30 and located outside of the reservoir 20. In the present example, the remaining quantity detector 60 is a sender gauge including an arm 62 holding a float 61. The float 61 floats in fuel stored in the fuel tank 2. The remaining quantity detector 60 detects a quantity of fuel remaining in the fuel tank 2 according to the rotation angle of the arm 62.

(Configuration)

As follows, a configuration of the fuel feed apparatus 1 will be described. As described above, the filter case 55 is supported in both the tanks 20, 2. As shown in FIG. 6, the fuel pump 52 has an upper portion having the fuel outlet port 52*b*. The inner space 55*c* of the inner tubular portion 55*a* accommodates the upper portion of the fuel pump 52. The fuel outlet port 52*b* being in a small-diameter tubular shape is loosely and coaxially inserted in a communication tubular portion 551 being in a large-diameter tubular shape. The communication tubular portion 551 is adjacent to the inner periphery of an upper portion of the inner tubular portion 55*a* of the filter case 55. The communication tubular portion 551 communicates with the space 55*d* accommodating the filter element 56. An elastic member 500 is interposed in the region between the communication tubular portion 551 and the fuel outlet port 52*b* to surround the region entirely in the circumferential direction. In the present example, the elastic member 500 is an annular O-ring formed of rubber. In the present structure, the elastic member 500 connects the filter case 55 with the fuel pump 52 and seals the filter case 55 from the fuel pump 52.

The suction filter 51 includes a pump bracket 510, a clip 511, and a filter element 512. The pump bracket 510 is in a bottomed tubular shape and formed of resin. As shown in FIG. 2, the pump bracket 510 is joined with the filter case 55 in the tanks 20, 2. As shown in FIG. 6, the fuel pump 52 has a lower portion (remaining portion) including the fuel inlet port 52*a* and the pump chamber 52*g*. The remaining portion of the fuel pump 52 is coaxially inserted in the pump bracket 510. In the present example, the fuel inlet port 52*a* is located in the pump bracket 510. The pump bracket 510 has a fitting hole 510*a* to which the fuel inlet port 52*a* is fitted. The pump bracket 510 has a sidewall portion 516 being in a tubular shape. In the present structure, the sidewall portion 516 surrounds the outer circumferential periphery of the pump chamber 52*g* entirely in the rotative direction of the rotor member 52*d* accommodated in the pump chamber 52*g*.

Figure 7:
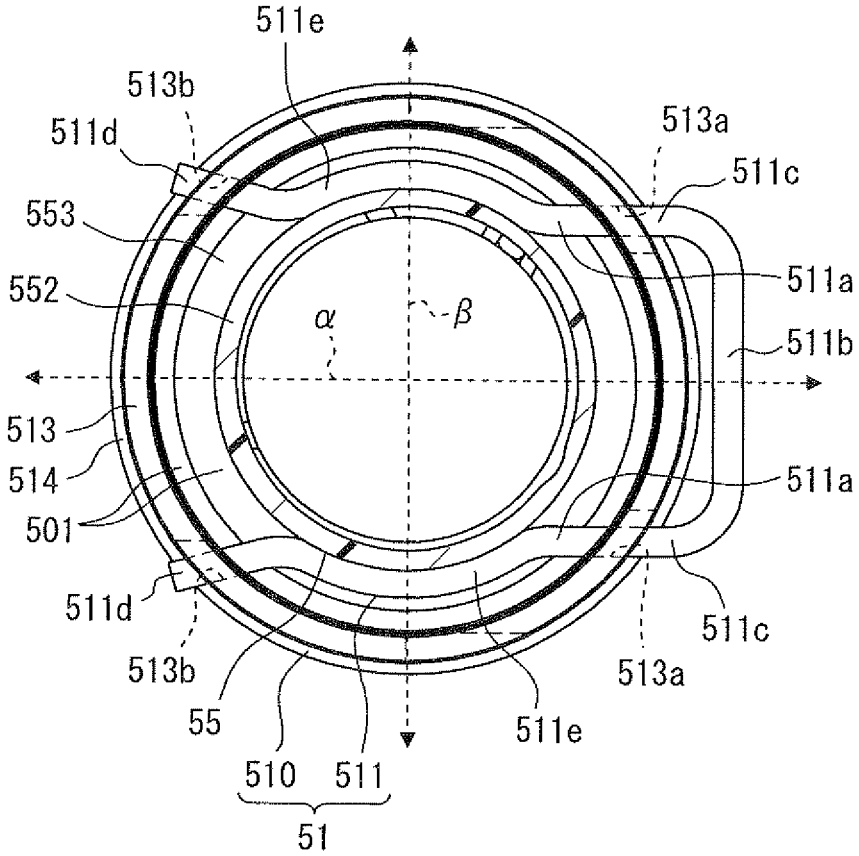
FIG. 7 is a sectional view taken along the line VI I-VII in FIG. 6.

As show in FIGS. 6, 7, the pump bracket 510 includes collar portions 514, 515 each being in a disc shape and a joint portion 513 being in a tubular shape. The collar portions 514, 515 interpose the sidewall portion 516 therebetween in the axial direction (vertical direction) of the rotor member 52*d*. The joint portion 513 projects upward from the collar portion 514. The filter case 55 includes a joint portion 552 being in a tubular shape and a collar portion 553 being in a disc shape. The joint portion 552 projects downward from the inner tubular portion 55*a*. The collar portion 553 projects radially outward from a lower end of the joint portion 552. The joint portion 552 and the collar portion 553 are inserted loosely and coaxially in the joint portion 513. In the present structure, the joint portion 513 of the pump bracket 510 and each of the components 552, 553 of the filter case 55 have a gap 501 therebetween in the radial direction of the rotor member 52*d*. Thereby, the pump bracket 510 is movable relative to the filter case 55 in the radial direction.

As shown in FIG. 7, the clip 511 is a U-shaped resilient member formed of metal. The clip 511 includes a joint portion 511*b* connected with a pair of clamp portions 511*a* at both ends. Each of the clamp portions 511*a* has a base end 511*c* on the side of the joint portion 511*b*. The pump bracket 510 has two joint holes 513*a* extending through two portions of the joint portion 513 in one radial direction a of the rotor member 52*d*. The base end 511*c* is inserted in corresponding one of the joint holes 513*a*. As shown in FIGS. 6, 7, each of the clamp portions 511*a* has a tip end 511*d* on the opposite side of the joint portion 511*b*. The joint portion 513 has joint holes 513*b* at two locations different from the joint holes 513*a*. Each of the joint holes 513*b* extends through the joint portion 513 in a direction inclined relative to the radial direction $\alpha$. The tip end 511*d* is inserted in corresponding one of the joint holes 513*b*. Each of the clamp portions 511*a* has an intermediate portion 511*e* between both ends 511*c*, 511*d*. The intermediate portion 511*e* is inserted in the gap 501. The intermediate portions 511*e* interpose the joint portion 552 of the filter case 55 therebetween in a radial direction $\beta$ of the rotor member 52*d*. The radial direction $\beta$ is one radial direction being perpendicular to the radial direction a and selected from any radial directions of the rotor member 52*d*.

In the present structure, the pump bracket 510 and the filter case 55 overlap each other in the radial direction to define the gap 501 therebetween. The clip 511 is attached to each of the joint portions 513, 552 of the pump bracket 510 and the filter case 55 in the rotation radial direction $\alpha$. Thereby, the clip 511 resiliently connects the joint portions 513, 552 with each other. In the present example, the joint portions 513, 552 defining the gap 501 therebetween function as an overlap portion. As shown in FIG. 6, the fuel pump 52 has a barycenter Cg on the upper side of the pump chamber 52*g* closer to the fuel outlet port 52*b*. The overlap portion is located on the radially outside of the barycenter Cg. Therefore, in the present example, the clip 511 is attached to each of the joint portions 513, 552, which overlap each other at the radially outer side of the barycenter Cg of the fuel pump 52. Thus, the clip 511 connects the pump bracket 510 with the filter case 55. As shown in FIG. 2, the pump bracket 510 connected with the filter case 55 in this way is floated and supported at the position spaced out from the bottom portion 20*a* of the reservoir 20, in the state where the collar portions 514, 553 define a slight gap therebetween.

The filter element 512 shown in FIG. 6 is a filter medium formed of, for example, a nonwoven fabric. The filter element 512 is located in a space 517 located on the radially outside of the sidewall portion 516 of the pump bracket 510. The filter element 512 is in an annular shape extending in the circumferential direction of the rotor member 52*d*. The space 517 accommodating the filter element 512 communicates with the fitting hole 510*a* to which the fuel inlet port 52*a* is fitted. In the present structure, the filter element 512 is enabled to filter fuel, which the fuel pump 52 draws from the reservoir 20 into the fuel inlet port 52*a* through the space 517.

As described above, in the fuel feed apparatus 1, the lower portion of the fuel pump 52 is inserted in the radially inside portion of the pump bracket 510. The lower portion of the fuel pump 52 has the pump chamber 52*g* accommodating the rotor member 52*d*. The outer circumferential periphery of the pump chamber 52*g* is surrounded by the sidewall portion 516 of the pump bracket 510. The pump bracket 510 is allowed to move relative to the filter case 55 by the gap 501 defined in the radial direction of the rotor member 52*d*. Therefore, even when oscillation is caused mainly in the radial direction as the rotor member 52*d* rotates in the pump chamber 52*g*, such oscillation can be restricted from being transmitted to the filter case 55 via the pump bracket 510 or to the tanks 20, 2 supporting the filter case 55.

The clip 511 is mounted to each of the joint portions 513, 552 defining the gap 501 therebetween and overlapping each other. Thereby, the pump bracket 510 is joined with the filter case 55 in the state where elastic deformation of the clip 511 allows relative movement by the gap 501. Therefore, direct transmission of oscillation can be restricted between the pump bracket 510 and the filter case 55. In addition, the clip 511 resiliently joining the pump bracket 510 with the filter case 55 reduces indirect transmission of oscillation therebetween.

Further, the filter case 55 is joined with the pump bracket 510 at the overlap portion between the joint portions 552, 513, which are distant from each other by the gap 501, at the radially outside of the barycenter Cg of the fuel pump 52. Therefore, the filter case 55 hardly oscillates due to transmission of oscillation from the fuel pump 52. In addition, the pump bracket 510 is joined with the filter case 55 thereby being floated and supported at a spaced position from the bottom portion 20*a* of the reservoir 20. Therefore, transmission of oscillation from the fuel pump 52, which is located radially inside of the pump bracket 510, to the bottom portion 20*a* of the reservoir 20 via the pump bracket 510 can be reduced.

In addition, the fuel pump 52 is joined with the filter case 55 via the fuel outlet port 52*b* and the elastic member 500. The fuel outlet port 52*b* is apt to oscillate with discharge of fuel to the outside of the tanks 20, 2. The elastic member 500 is interposed between the fuel outlet port 52*b* and the communication tubular portion 551. In this way, the fuel pump 52 is supported by the filter case 55 in the state where the elastic member 500 attenuates oscillation of the fuel outlet port 52*b*.

In the fuel feed apparatus 1 having the present structure, abnormal noise caused by transmission of oscillation in the fuel pump 52 to the tanks 20, 2 via the pump bracket 510 and the filter case 55 can be steadily attenuated. In addition, the filter element 512 is annularly arranged around the sidewall portion 516, which surrounds the pump chamber 52*g* of the pump bracket 510. Therefore, the filter element 512 attenuates abnormal noise caused with rotation of the rotor member 52*d* in the pump chamber 52*g* of the fuel pump 52. The filter element 512 also filters fuel drawn by the fuel pump 52 from the reservoir 20. Therefore, both reduction in abnormal noise and suppression of increase in manufacturing cost can be achieved.

(Other Embodiment)

As described above, the present invention is not limited to the above embodiment, and is capable of being applied to various embodiments as long as being undeviating from the gist thereof.

Specifically, for example, the joint structure between the filter case 55 and the pump bracket 510 may be a snap fitting structure such that the gap 501 is formed in the radial direction of the rotor member 52*d* to enable relative movement between the components 55, 510. The filter case 55 may be joined with the pump bracket 510 on the radially outside at a position different from the barycenter Cg of the fuel pump 52. The case accommodating a part of the fuel pump 52 and joined with the pump bracket 510 may be a component other than the filter case 55 of the fuel filter 53. For example, the case may be an exclusive case component for an exclusive use to cause the reservoir 20 to support fuel pump 52. In this case, the fuel outlet port 52*b* may not be connected with the exclusive case component.

The pump bracket 510 is not limited to have the structure including the suction filter 51 having the annular filter element 512 located at the radially outside of the sidewall portion 516. For example, the pump bracket 510 may be an exclusive component for an exclusive use to receive the remaining portion of the fuel pump 52. The pump bracket 510 may be provided to the bottom portion 20*a* of the reservoir 20. The above-described structural feature may be applied to a fuel feed apparatus, which does not include the reservoir 20. The rotor member 52*d* accommodated in the pump chamber 52*g* of the fuel pump 52 is not limited to the impeller having the vane grooves 52*h*. The rotor member 52*d* may be another component being rotative and configured to pump fuel.

Summarizing the above embodiments, a fuel feed apparatus is configured to supply furl in a tank to an exterior of the tank. The fuel feed apparatus includes a fuel pump having a pump chamber accommodating a rotor member and configured to discharge fuel to the exterior of the tank with rotation of the rotor member. The fuel feed apparatus further includes a case supported in the tank and accommodating a part of the fuel pump. The fuel feed apparatus further includes a pump bracket formed in a bottomed tubular shape and located in the tank. The pump bracket has an inner circumferential periphery into which a remaining portion of the fuel pump is inserted. The pump bracket has a sidewall portion surrounding a radially outside of the pump chamber of the remaining portion. The pump bracket is connected with the case to have a gap in a radial direction of the rotor member such that the pump bracket is movable relative to the case.

In the present structure, a part of the fuel pump is accommodated in the case supported in the tank. The fuel pump has the remaining portion other than the part of the fuel pump accommodated in the case. The remaining portion has the pump chamber accommodating the rotor member. The remaining portion is inserted in the radially inside of the pump bracket being in the bottomed tubular shape. The sidewall portion of the pump bracket surrounds the radially outside of the remaining portion. The pump bracket joined with the case is allowed to move with respect to the case by the gap opened in the radial direction of the rotor member. Vibration is caused mainly in the radial direction due to rotation of the rotor member in the pump chamber. In the present structure, transmission of such vibration to the case can be restricted. Further, transmission of such vibration to the tank supporting the case can be also restricted. In this way, abnormal noise caused by transmission of vibration from the fuel pump to the tank can be reduced.

In the above-described structure, the case and the pump bracket overlap one another to have an overlap portion therebetween at the radially outside of the barycenter of the fuel pump. The case and the pump bracket are joined at the overlap portion to define the gap therebetween. In the present structure, the case is joined with the pump bracket at the overlap portion located on the radially outside of the barycenter of the fuel pump to define the gap therebetween. Thereby, the pump bracket hardly vibrates due to transmission of vibration from the fuel pump. In the present structure, the pump bracket is also allowed to move relative to the case by the gap opened in the radial direction of the rotor member. In addition, abnormal noise caused by transmission of vibration from the fuel pump can be further reduced.

In the present structure, the fuel pump has a fuel outlet port for discharging fuel supplied to the outside of the tank. The elastic member is interposed between the fuel outlet port and the case to connect the fuel outlet port with the fuel pump. In the present structure, the fuel outlet port is apt to vibrate due to fuel supply to the outside of the tank. The elastic member is interposed between the fuel outlet port and the case. The elastic member causes the fuel pump to support the case connected in the state where vibration of the fuel outlet port can be attenuated. In the present structure, the pump bracket is also allowed to move relative to the case by the gap opened in the radial direction of the rotor member. In addition, abnormal noise caused by transmission of vibration from the fuel pump can be further reduced.

In the above-described structure, the case is joined with the pump bracket via the clip being a resilient member. In the present structure, the clip joining the case with the pump bracket causes elastic deformation to allow the case and the pump bracket to move relative to each other by the gap in the radial direction of the rotor member. In addition, the clip elastically joining the case with the pump bracket in this way attenuates vibration transmitted via the clip. Thus, abnormal noise caused by oscillation transmitted from the fuel pump can be further attenuated.

In the above-described structure, the case and the pump bracket overlap one another at the overlap portion to define the gap therebetween. The clip is provided to the overlap portion. In the present structure, the clip is mounted to the overlap portion defining the gap between the case and the pump bracket. Thereby, relative movement between the case and the pump bracket is allowed by the gap. Therefore, direct transmission of vibration between the case and the pump bracket can be restricted. Thus, abnormal noise caused by vibration transmitted from the fuel pump can be further attenuated.

The pump bracket is joined with the case. Thereby, the pump bracket is floated and supported at a position spaced out from the bottom portion of the tank. In the present structure, the pump bracket is joined with the case, thereby being floated and supported at the position spaced from the bottom portion of the tank. In this way, transmission of vibration from the fuel pump located in the pump bracket to the bottom portion of the tank can be restricted. In the present structure, the pump bracket is also allowed to move relative to the case by the gap opened in the radial direction of the rotor member. In addition, abnormal noise caused by transmission of vibration from the fuel pump can be further reduced.

In the above-described structure, the fuel feed apparatus further includes a filter element provided annularly to the radially outside of the sidewall portion of the pump bracket and configured to filter fuel drawn by the fuel pump from the tank. In the present structure, the annular filter element is located on the radially outer side of the sidewall portion of the pump bracket surrounding the radially outside of the pump chamber. Therefore, even when the fuel pump causes abnormal noise due to rotation of the rotor member in the pump chamber, the annular filter element attenuates such abnormal noise. The filter element also filters fuel drawn by the fuel pump from the tank. Therefore, both reduction in abnormal noise and suppression of increase in manufacturing cost can be achieved.

It should be appreciated that while the processes of the embodiments of the present invention have been described herein as including a specific sequence of steps, further alternative embodiments including various other sequences of these steps and/or additional steps not disclosed herein are intended to be within the steps of the present invention.

Various modifications and alternations may be diversely made to the above embodiments without departing from the spirit of the present invention.

What is claimed is:

1. A fuel feed apparatus configured to supply fuel from a tank to an exterior of the tank, the fuel feed apparatus comprising:

a fuel pump having a pump chamber accommodating a rotor member, the rotor member being rotatable to supply fuel to the exterior of the tank;

a case supported in the tank, the case accommodating a part of the fuel pump; and a pump bracket located in the tank, the pump bracket being in a tubular bottomed shape having a sidewall portion in which a remaining portion of the fuel pump is inserted such that the sidewall portion surrounds a radially outside of the pump chamber of the remaining portion, the pump bracket being joined with the case to define a gap therebetween in a radial direction of the rotor member such that the pump bracket is movable relative to the case, wherein the case and the pump bracket overlap one another to have an overlap portion therebetween at a radially outside of a barycenter of the fuel pump, and the case and the pump bracket are joined with each other at the overlap portion to define the gap therebetween.

2. The fuel feed apparatus according to claim 1, wherein the fuel pump has a fuel outlet port for discharging fuel supplied to the exterior of the tank, the fuel feed apparatus further comprising:

an elastic member interposed between the case and the fuel outlet port, wherein the elastic member connects the case with the fuel pump.

3. The fuel feed apparatus according to claim 1, further comprising:

a clip being resilient and configured to join the case with the pump bracket.

4. The fuel feed apparatus according to claim 3, wherein the case and the pump bracket overlap one another at the overlap portion to define the gap therebetween, and the clip is provided to the overlap portion.

5. The fuel feed apparatus according to claim 1, wherein the pump bracket is joined with the case such that the pump bracket is floated and supported at a position spaced out from a bottom portion of the tank.

6. The fuel feed apparatus according to claim 1, further comprising:

a filter element being in an annular shape, the filter element being located on a radially outside of the sidewall portion of the pump bracket and configured to filter fuel drawn by the fuel pump from the tank.

7. The fuel feed apparatus according to claim 1, wherein the remaining portion of the fuel pump is other than the part of the fuel pump accommodated in the case.

8. The fuel feed apparatus according to claim 1, wherein the case is partially inserted into the pump bracket to overlap one another in an axial direction of the case.

* * * * *